US005113934A

United States Patent [19]

Potier

[11] Patent Number: 5,113,934

[45] Date of Patent: May 19, 1992

[54] HEAT EXCHANGER OF REDUCED WIDTH

[75] Inventor: Michel Potier, Rambouillet, France

[73] Assignee: Valeo Thermique Moteur, France

[21] Appl. No.: 777,665

[22] Filed: Oct. 15, 1991

[30] Foreign Application Priority Data

Oct. 17, 1990 [FR] France ..... 90 12836

[51] Int. Cl.[5] ..... F28F 9/02

[52] U.S. Cl. ..... 165/173; 165/149

[58] Field of Search ..... 165/149, 173; 29/890.052, 890.08

[56] References Cited

U.S. PATENT DOCUMENTS 2,434,988 1/1948 Christensen ..... 165/149
5,062,476 11/1991 Ryan et al. ..... 165/173

FOREIGN PATENT DOCUMENTS 371532 6/1990 European Pat. Off. ..... 165/173
556552 2/1957 Italy ..... 165/149
63-140296 6/1988 Japan ..... 165/173

*Primary Examiner*—Allen J. Flanigan

*Attorney, Agent, or Firm*—Morgan & Finnegan

[57] ABSTRACT

A heat exchanger comprises a fluid box in the form of an elongated vessel having two side walls, two end walls and a base wall, the fluid box being sealingly closed by a welded cover plate on the side opposite to the base wall. The heat exchanger also has at least one bank of tubes which lie mainly outside the fluid box and which communicate sealingly with the interior of the latter through holes formed in the base wall. The side walls of the fluid box extend generally parallel to the plane containing the axes of the tubes of one bank, and include in the vicinity of the cover plate a shoulder which is directed outwardly to serve as a support for welding the cover plate in position. The distance, measured in a transverse direction, between the inner face of each side wall of the fluid box and the axes of the tubes of the bank of tubes closest to it is, at the level of the shoulder smaller than the maximum dimension of the tubes in the same transverse direction. This is achieved mainly by virtue of a hip formed in the side walls, which reduces the overall width of the heat exchanger.

3 Claims, 1 Drawing Sheet

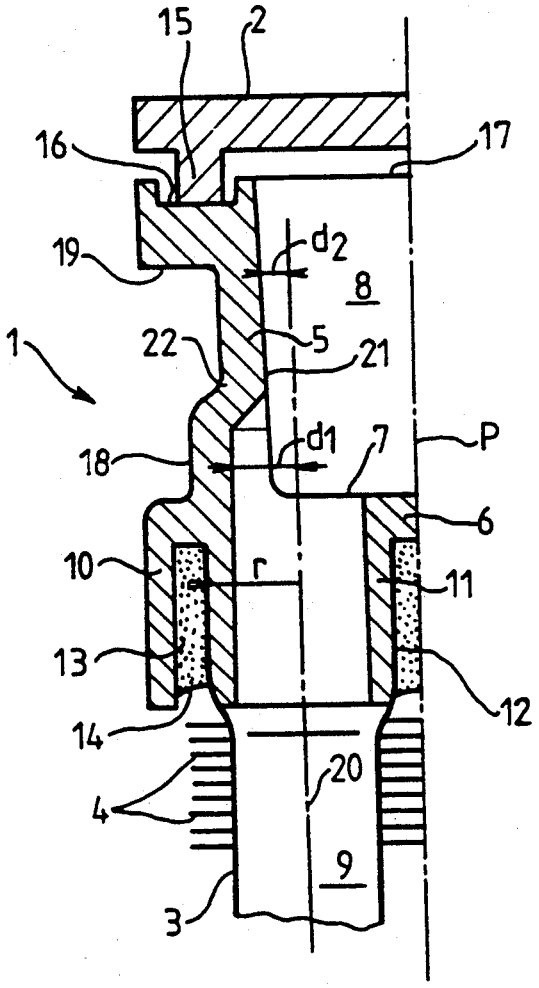
15
2
16
17
19
d2
8
1
22
5
21
d1
7
P
18
6
10
r
11
13
12
14
20
4
9
3

HEAT EXCHANGER OF REDUCED WIDTH

FIELD OF THE INVENTION

This invention relates to a heat exchanger comprising a fluid box in the form of an elongated vessel having two side walls, two end walls and a base wall which acts as a header plate, the fluid box being sealingly closed by a cover plate which is welded over the fluid box on the opposite side of the latter from the base wall, the heat exchanger further including at least one bank of tubes which lie mainly outside the fluid box, with each tube being aligned with a hole formed in the base wall of the fluid box and having a tube end or end portion which is sealingly secured to the latter so as to bring the interior of the tube into communication with the interior of the fluid box, with the side walls of the fluid box extending generally parallel to the plane containing the axes of the tubes in a said tube bank, the side walls including, in the vicinity of the cover plate, a shoulder directed outwardly to act as a support for the welding of the cover plate to the fluid box.

BACKGROUND OF THE INVENTION such heat exchangers are used in particular as radiators for low temperature auxiliary circuits in motor vehicles, and are generally mounted between the radiator grille and the main radiator of the engine of the vehicle. The space which is available to accommodate this auxiliary radiator is therefore very limited, especially where the vehicle is one fitted with an air conditioning system and it is also necessary to place a condenser in the same space.

DISCUSSION OF THE INVENTION

An object of the invention is to reduce the transverse width of the heat exchanger.

According to the invention, in a heat exchanger of the kind defined under "Field of the Invention" above, the distance between the internal face of each of the said side walls and the axes of the tubes of the tube bank closest to it is, on a level with the shoulder, smaller than half of the maximum dimension of the tubes in the same transverse direction in which the said distance is measured.

In the absence of the arrangement which is provided in accordance with the invention, the transverse size of the fluid box, and therefore of the heat exchanger as a whole, would be at least equal to that of the bundle of tubes plus twice the thickness of the side wall and the width of the shoulder. The invention enables the size to be reduced below this limiting value.

In one form of the invention, the side walls of the fluid box include, between the ends of the tubes and the shoulder, hips which increase the distance between their inner faces and the axes of the tubes in the vicinity of the ends of the tubes.

According to another feature of the invention, a peripheral flange, together with a plurality of tubular projections surrounding the respective holes in the base wall of the fluid box, projecting from the base wall outwardly of the fluid box, with the ends of the tubes being fitted around the projections and sealingly fastened to the latter by means of an adhesive material which covers the outer face of the base wall within the flange and around the tubes.

Further features and advantages of the invention will appear more clearly from the description given below of a preferred embodiment of the invention, with reference to the single FIGURE of the accompanying drawing.

BRIEF DESCRIPTION OF THE DRAWING

The drawing is a view in transverse cross section of part of a heat exchanger in accordance with the invention.

DESCRIPTION OF A PREFERRED EMBODIMENT OF THE INVENTION

The drawing shows a heat exchanger having two banks of tubes. The representation shown in the drawing is limited on the right hand side by the longitudinal plane of symmetry p of the heat exchanger. The latter comprises a water box 1 in the form of a vessel having a cover plate 2. The drawing also shows the end portion, adjacent to the water box, of a heat exchange tube 3 of the associated bank, extending through cooling fins 4. The water box 1 is open at the top as shown. On the left hand side it is limited by a side wall 5, and at the bottom by a base 6, in which through holes 7 bring the interior 8 of the water box into communication with the interior 9 of the heat exchange tubes, so that the base wall 6 acts as a header plate for these tubes. The base wall 6 has a peripheral flange 10 and tubular projections 11 which surround the holes 7. The flange 10 and projections 11 extend vertically downwards as shown, i.e. perpendicular to the general plane of the base wall 6 and towards the outside of the water box 1. The flared ends 12 of the tubes 3 are fitted around the projections 11. The base wall 6, the flange 10 and the projections 11 define a free space 13 outside the base wall and its projections, and inside the flange 10. This free space 13 is in the form of a network of channels open at the bottom and filled with a suitable adhesive material 14, which seals the tubes 3 to the water box 1.

The cover plate 2 is arranged to be friction welded to the water box, and for this purpose it has a peripheral lip 15 which is directed downwardly to engage on an upwardly directed surface 16 of the water box 1. This surface 16 forms the base of a peripheral groove formed in the upper face 17 of the water box. The external face 18 of the side wall 5 has a shoulder 19 which is directed outwardly and which faces the lip 15, to serve as an abutment during welding of the cover plate in position. Between the ends 12 of the tubes and the shoulder 19, the side wall 5 has a hip 22 at the upper end of the widened lower portion of the water box, in the vicinity of the tube ends.

If the radius of the end 12 of a tube 3, that is to say the maximum dimension of the tube in the transverse direction is r, with $d_1$ being the distance between the axis 20 of the tube 3 and the inner face 21 of the side wall 5 below the hip 22, and with $d_2$ being the distance between the same axis and the same face above the hip 22, and in particular at the level of the shoulder 19, then $d_1$ is the radius of the holes 7. Due to the penetration of the projections 11 into the tubes 3, $d_1$ is then smaller than r. Because of the presence of the hip 22, $d_2$ is smaller than $d_1$. It follows that $d_2$ is smaller than r, which reduces the overall width of the heat exchanger for any given set of dimensions and disposition of the tubes.

The invention is not limited to the embodiment described and shown. It is also applicable to heat exchangers which have only a single bank of tubes, or more than two banks; and, regardless of the purpose of the heat exchanger, the invention is useful whenever it is important to limit its lateral size.

In addition, mention has been made in the above description of a distance r which in the example given is the radius of a round tube. If the tube is of flat or oval shape, this distance r is to be considered as being the maximum dimension of the tube in the transverse direction which corresponds substantially to half of the largest transverse dimension of the tube.

In addition, it can be arranged that the ends of the tubes are connected to the base wall of the water box by being force fitted to the latter, either directly within the holes, such as the holes 7, of the latter, or by means of an interposed elastomeric seal.

What is claimed is:

1. A heat exchanger comprising a fluid box in the form of an elongated vessel having two side walls each having an inner face, two end walls, and a base wall with holes formed through the latter; a cover plate overlying the vessel; at least one bank of tubes extending mainly externally of the fluid box and each defining a tube axis, with each tube being aligned with a respective hole in the base wall of the fluid box and having an end portion; and means sealingly joining each said tube end portion to the base wall of the fluid box so as to bring the interior of the latter into communication with the interior of the tube, with the said side walls of the fluid box extending generally parallel to a plane containing the axes of the tubes of one said bank, and with the side walls of the fluid box being formed with an outwardly directed shoulder in the vicinity of the cover plate to serve as a support for welding of the cover plate to the fluid box, wherein the distance, measured in a transverse direction of the fluid box, between the said inner face of each side wall and the axes of the tubes of the bank of tubes closest thereto is, at the level of the said shoulder, smaller than one half of the maximum dimension of the tubes in the transverse direction.

2. A heat exchanger according to claim 1, wherein the walls have, between the tube ends and the said shoulder, hips which increase the said distance in the region of the ends of the tubes.

3. A heat exchanger according to claim 1 or claim 2, wherein the base wall of the fluid box has a peripheral flange and is further provided with tubular projections surrounding the holes and projecting outwardly from the base wall, with the tube ends being fitted around the tubular projections, the heat exchanger further including an adhesive material fastening the tube ends sealingly to the tubular projections, with the adhesive material covering the outer face of the base wall, within the peripheral flange and around the tubes.

* * * * *